US007092647B2

(12) United States Patent
Suzuki

(10) Patent No.: US 7,092,647 B2
(45) Date of Patent: Aug. 15, 2006

(54) IMAGE FORMING APPARATUS

(75) Inventor: Hideaki Suzuki, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 14 days.

(21) Appl. No.: 10/793,802

(22) Filed: Mar. 8, 2004

(65) Prior Publication Data

US 2004/0179856 A1 Sep. 16, 2004

(30) Foreign Application Priority Data

Mar. 10, 2003 (JP) ..... 2003-063916

(51) Int. Cl.
*G03G 15/08* (2006.01)

(52) U.S. Cl. ..... 399/27; 399/49; 399/60; 399/61; 399/258

(58) Field of Classification Search ..... 399/9, 399/24, 27, 29, 30, 61, 49, 60, 62, 258, 259, 399/260, 262

See application file for complete search history.

(56) References Cited

U.S. PATENT DOCUMENTS

| | | | | |
|---|---|---|---|---|
| 6,292,640 | B1 | 9/2001 | Suzuki | 399/175 |
| 6,349,183 | B1 * | 2/2002 | Nagamine et al. | 399/27 |
| 6,892,037 | B1 * | 5/2005 | Ohkubo | 399/27 |

FOREIGN PATENT DOCUMENTS

| | | |
|---|---|---|
| JP | 5-27598 | 2/1993 |

* cited by examiner

*Primary Examiner*—Hoang Ngo
(74) *Attorney, Agent, or Firm*—Fitzpatrick, Cella, Harper & Scinto

(57) ABSTRACT

This invention realizes and provides an image forming apparatus in which the presence or absence of a toner remaining in a toner storing portion is judged by a patch detecting method, characterized in that the wrong detection of the judgment of the presence or absence of the toner can be prevented and the lowering of image density can be suppressed. In an image forming apparatus having a first toner supply controller for controlling the driving time of a toner supplying portion on the basis of the video count number of the density signal of an image information signal, and a second toner supply controller for correcting the driving time of the toner supplying portion determined by the first toner controller, and designed such that the presence or absence of the toner remaining in the toner storing portion is judged on the basis of the density signal of a standard toner image, when the density signal of the standard toner image is equal to or less than a predetermined value, the driving time of the toner supplying portion additionally corrected per image by the second toner supply controller is made longer than when the density signal of the standard toner image is greater than the predetermined value.

7 Claims, 7 Drawing Sheets

IMAGE FORMING APPARATUS

BACKGROUND OF THE INVENTION

1. Field of the Invention

The invention relates to an image forming apparatus using an electrophotographic process, an electrostatic recording process or the like, and particularly to an image forming apparatus such as a copying machine, a printer or a facsimile apparatus, or a compound machine having a plurality of these functions.

2. Related Background Art

In conventional image forming apparatuses of an electrophotographic type, and above all, particularly a multi-color image forming apparatus for effecting color image forming, there has been widely utilized two-component development using a mixture of a nonmagnetic toner and a magnetic carrier as a developer.

The two-component development, as compared with presently proposed other developing processes, has such merits as the stability of image and the durability of apparatus, while on the other hand, only the toner is consumed with image forming and therefore, in conformity therewith, it is necessary to suitably supply the toner and control toner density (the weight ratio of the toner to the weight of the whole developer) within an appropriate range. It is a very important factor in stabilize the quality of image to control the toner density within an appropriate range, and various methods have heretofore been proposed and put into practical use.

For example, there have heretofore been proposed and practiced a method of directly detecting toner density in a developing device by the use of an optical sensor, a method of directly detecting toner density in a developing device by the use of an inductance sensor, a method of detecting the density of a patch image by an optical sensor to thereby indirectly detect toner density in a developing device (hereinafter referred to as the patch method), a method of indirectly detecting toner density in a developing device by the use of a video counter for integrating an image information signal (hereinafter referred to as the video count method), etc. The amount of toner to be supplied to the developing device is determined on the basis of the toner density detected by one of these methods.

Among them, the patch method is a method of reading the density of a reference toner image (hereinafter referred to as the "patch image") formed on a photosensitive member as an image bearing member by a light source provided at a location opposed to the surface thereof and a sensor for receiving the reflected light thereof, and controlly the toner supply amount on the basis of the output value thereof to thereby effect toner density control. This method is widely used because when in a multi-color image forming apparatus, a plurality of developing apparatuses are provided around the photosensitive member, it is not necessary to provide a sensor for each developing apparatus and this is advantageous in terms of cost.

Also, when the patch detecting method is adopted for the toner density control of a two-component developer, it is desirable to widen the interval at which the patch images are formed to the utmost, from the point that consumption of excess toner becomes necessary to form the patch images, and the point that the ordinary image forming operation must be discontinued during the formation of the patch images and this becomes a factor which reduces productivity.

So, use is made of a method as described in Japanese Patent Application Laid-Open No. H5-27598 wherein the video count method is used in addition to the patch method. The video count method is a method of foreseeing the toner consumption amount from the integrated value of the video count number of the image density of an image information signal read by a CCD or the like, and effecting an amount of toner supply corresponding thereto, and the toner supply amount is calculated and supplied during each image forming operation, and this leads to the advantage that when a great amount of toner is consumed as when forming an image of high density, the toner supply is controlled so as to quickly provide proper developer density. On the other hand, when there is a difference between the toner consumption amount foreseen from the video count number and the actual toner consumption amount, there is the possibility that the toner density in the developer gradually deviates from a proper range.

So, use has heretofore been made of a combined method of normally effecting toner density control by the video count method, and effecting toner density control by the patch detecting method when the image forming operation has reached a predetermined number of times.

This combined method, as compared with the controlling method using only the patch detecting method, can greatly widen the interval between the patch detecting operations, and also can correct the deviation of the toner consumption amount by the video count method, by the patch detecting method and can therefore be said to be a very excellent method.

Now, when the image forming apparatus continues to be used for a long period of time, the toner in a toner storing portion storing therein the toner to be supplied becomes exhausted and therefore, a design is made such that the presence or absence of the toner remaining in this toner storing portion is judged to thereby call upon a user to supply a fresh toner. When this toner storing portion is made into a cartridge type detachably attachable to the image forming apparatus, a design should preferably be made such that if the toner in the toner storing portion is judged to be substantially absent, the user is called upon to interchange the toner storing portion made into a cartridge.

As this residual toner amount detecting means, there have heretofore been proposed and carried out a method using a piezosensor, a method using an antenna sensor, a method using an optical sensor, etc.

As another method, there is a method serving as toner presence or absence detecting means and toner density controlling means by the use of the output of a sensor for detecting the above-described patch image. Specifically, when the detection output of the patch image is a predetermined value or less or when an output of a predetermined value or less continues a plurality of times, the absence of the toner is judged. This method can perform both of toner presence or absence detection and toner density control by a single sensor and therefore, does not require the provision of a sensor exclusively for toner presence or absence detection, and is a very excellent method in terms of cost.

This method, however, performs toner presence or absence detection and toner density control by a single sensor and therefore, simply by looking at the detection output of the patch image, it is difficult to judge whether the toner is truly absent or the density of the patch image has become low due to any other factor than the toner density.

To enhance the accuracy of this toner presence or absence judgment, a threshold value to be compared with the sensor output detecting the patch image density when the absence of the toner is judged can be set to a considerably low value, but if this is done, the ordinary image density will be greatly lowered in the vicinity of the absence of the toner, and this is not preferable in practical use. Conversely, if the threshold value is set to a higher value, the lowering of the density can be suppressed, but the risk of misjudging the presence or absence of the toner will heighten.

SUMMARY OF THE INVENTION

It is an object of the present invention to provide an image forming apparatus in which the amount of toner supplied to a developing device can be made proper even if the amount of remaining toner in a toner container becomes small.

It is also an object of the present invention to provide an image forming apparatus in which the amount of toner supplied to a developing device can be made proper in accordance with the output of a density sensor.

It is also an object of the present invention to provide an image forming apparatus having a developing device for developing an electrostatic image formed on an image bearing member in accordance with an image signal with a developer including a toner and a carrier, a toner container containing the toner therein, a supplying member for supplying the toner from the toner container to the developing device, and controlling means for controlling an amount of toner supply to the developing device in accordance with the image signal, wherein when the amount of remaining toner in the toner container is small, the driving time of the supplying member conforming to the image signal is lengthened.

Further, it is also an object of the present invention to provide an image forming apparatus having a developing device for developing an electrostatic image formed on an image bearing member in accordance with an image signal with a developer including a toner and a carrier, a supplying member for supplying the toner to the developing device, controlling means for controlling an amount of toner supply to the developing device in accordance with the image signal, a density sensor for detecting the density of a reference toner image formed by the developing device, correcting means for correcting the amount of toner supply conforming to the image signal on the basis of the output of the density sensor, and changing means for changing the driving time of the supplying member conforming to the image signal on the basis of the output of the density sensor.

Further objects of the present invention will become apparent from the following detailed description when read with reference to the accompanying drawings.

DETAILED DESCRIPTION OF THE PREFERRED EMBODIMENTS

An image forming apparatus according to the present invention will hereinafter be described in greater detail with reference to the drawings.

First Embodiment

Figure 1:
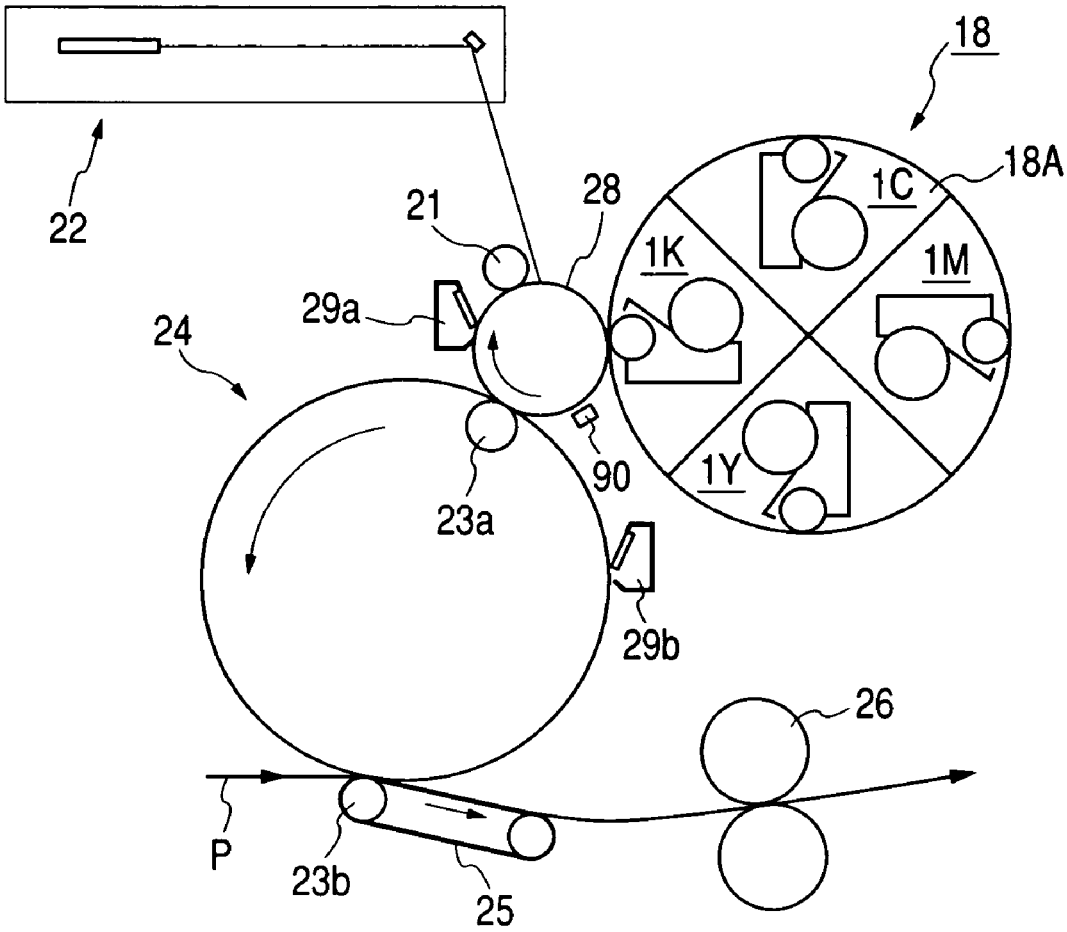
FIG. 1 schematically shows the construction of an embodiment of the image forming apparatus of the present invention.

An embodiment of the image forming apparatus according to the present invention will first be described. The image forming apparatus of the present embodiment, as shown in FIG. 1, has a photosensitive drum 28 which is an electrophotographic photosensitive member as an image bearing member carried for rotation in the direction of arrow, and is provided with a primary charging device 21, developing means 18, an intermediate transfer member 24, a cleaner 29*a* and an exposing apparatus 22 around the photosensitive drum.

In the present embodiment, the developing means 18 disposed in opposed relationship with the photosensitive drum 28 is developing means of a rotary developing type, and is provided with a rotary member 18A rotatively driven by a motor (not shown). The rotary member 18A carries thereon four developing apparatuses 1 in the present embodiment, i.e., a developing apparatus 1K for black, a developing apparatus 1Y for yellow, a developing apparatus 1M for magenta, and a developing apparatus 1C for cyan.

When a black toner image is to be formed on the photosensitive drum 28, developing is effected at a developing position opposed to the photosensitive drum 28 by the developing apparatus 1K for black, and when likewise a yellow toner image is to be formed, the rotary member 18A is rotated by 90° to thereby dispose the developing apparatus 1Y for yellow at the developing position, thus effecting developing. The forming of magenta and cyan toner images is effected in the same manner.

A description will now be made of the operation of the entire apparatus during a full-color image forming mode.

In FIG. 1, the surface of the photosensitive drum 28 charged by the primary charging device 21 is exposed to light by the exposing apparatus 22 such as a laser beam scanner to thereby form an electrostatic latent image on the photosensitive drum 28. This electrostatic latent image is developed by the developing apparatus 1 (1k, 1Y, 1M, 1C) containing a desired toner therein, whereby a toner image is formed on the photosensitive drum 28. This toner image is transferred onto the intermediate transfer member 24 by a first transferring bias from a first transfer charging device 23*a*.

When forming of a full-color image is to be effected, a black toner image is first formed on the photosensitive drum 28 by the developing apparatus 1K for black, and the black toner image is primary-transferred onto the intermediate transfer member 24.

Next, the rotary member 18A is rotated by 90° to thereby dispose the developing apparatus 1Y for yellow at the developing position, and a yellow toner image is formed on the photosensitive drum 28, and the yellow toner image is transferred and superposed onto the black toner image on the aforementioned intermediate transfer member 24. Such operation is sequentially performed also in the developing apparatus 1M for magenta and the developing apparatus 1C for cyan to thereby form a desired full-color image on the intermediate transfer member 24.

Thereafter, the full-color image on the intermediate transfer member 24 is collectively secondary-transferred to recording paper P on a transfer paper conveying belt 25 by a second transferring bias from a second transfer charging device 23*b*. The recording paper P having the full-color image thereon is stripped off from the transfer paper conveying belt 25, and is pressurized and heated by a fixing apparatus 26 to thereby obtain a permanent image.

Also, any residual toners residual on the photosensitive drum 28 after the primary transfer are removed by a first cleaner 29*a*, and any residual toners residual on the intermediate transfer member 24 after the secondary transfer are removed by a second cleaner 29*b*, and thus the photosensitive drum becomes ready for the next image forming.

Figure 2:
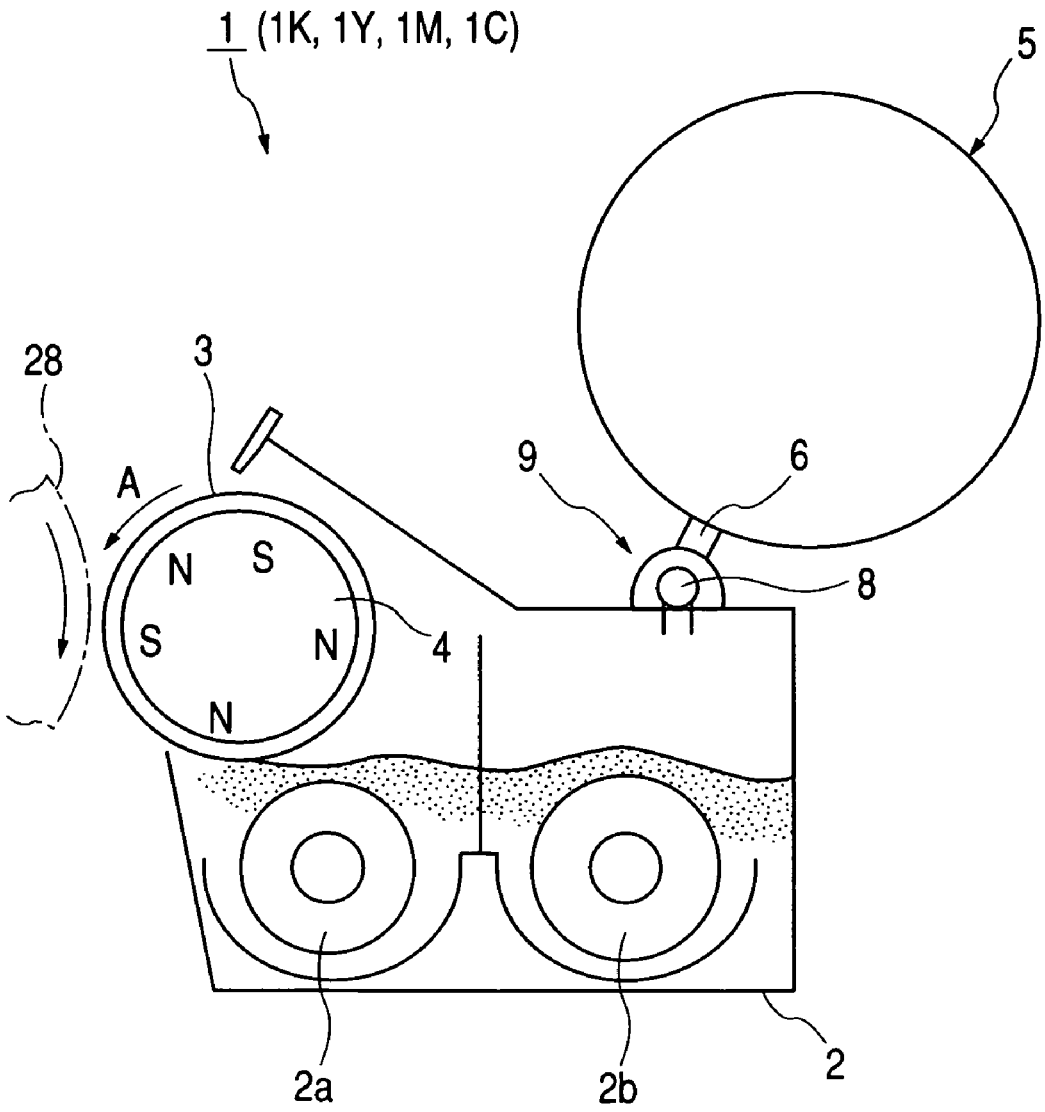
FIG. 2 schematically shows the construction of an embodiment of a developing apparatus.

The detailed construction of the developing apparatus 1 will now be described with reference to FIG. 2.

The developing apparatus 1 (1K, 1Y, 1M, 1C) contains therein a two-component developer including a nonmagnetic toner and a magnetic carrier, and developer density (the weight ratio of the toner to the weight of the entire developer) in an initial state is adjusted to 7%. This value should be properly adjusted by the charging amount of the toner, the particle diameter of the carrier, the construction of the image forming apparatus, etc., and need not always be absolute.

The developing apparatus 1 has a developing area opening to the photosensitive drum 28, and a developing sleeve 3 is rotatably disposed in this opening portion in such a manner as to be partly exposed. The developing sleeve 3 containing therein a stationary magnet 4 which is magnetic field generating means is formed of a nonmagnetic material, is rotated in a direction indicated by arrow A in FIG. 2 during the developing operation, holds the two-component developer in a developing container 2 in the form of a layer and carries it to the developing area, and supplies the developer to the developing area opposed to the photosensitive drum 28 to thereby develop the electrostatic latent image formed on the photosensitive drum 28. The developer after having developed the electrostatic latent image is carried in accordance with the rotation of the developing sleeve 3, and is collected into the developing container 2.

Also, in the developing container 2, there are provided a first agitating screw 2*a* (a side near to the developing sleeve 3) and a second agitating screw 2*b* (a side far from the developing sleeve 3), and by these, the developer is circulated in the developing container 2.

Also, in the developing apparatus 1, there is set a toner cartridge 5 (toner supplying container) as a toner container detachably provided in an image forming apparatus main body, and the toner supplied from the toner cartridge 5 is mixed with the developer in the developing container 2 and agitated by the first agitating screw 2*a* and the second agitating screw 2*b*. The toner cartridge 5 for any of black, yellow, magenta and cyan is of a substantially cylindrical shape, and is easily detachably attachable to the rotary member 18A and the developing apparatus 1.

In this case, a design is made such that when the amount of remaining toner in the toner cartridge becomes small and a state insufficient to effect ordinary image forming is brought about, an operator takes the used toner cartridge out of the image forming apparatus and insert an unused new toner cartridge into the image forming apparatus.

The toner contained in the toner cartridge 5 is conveyed past a discharge port 6 to a toner supplying portion 9 disposed on the developing container 2, and is supplied into the developing container 2 in accordance with the rotation of a toner supplying screw 8 as a supplying member. The amount of toner supply into the developing container 2 is roughly determined by the rotating time of this toner supplying screw 8, and a description will hereinafter be made specifically of toner supply controlling means for controlling this rotating time.

Instead of the toner cartridge type, there may be adopted a construction in which a conventional hopper (toner supplying container) as a toner container is fixedly disposed in the image forming apparatus so that the toner may be supplied from this hopper into the developing container. In this case, design is made such that when the amount of remaining toner in the hopper becomes small and a state insufficient to effect ordinary image forming is brought about, the operator supplies the toner to this hopper.

When the image forming operation is repeated, the toner in the developing container 2 is consumed and the toner density of the developer lowers and therefore, it is necessary to suitably supply the toner to thereby control the toner density within a desired range.

In the present embodiment, there is provided first toner supply controlling means for controlling the rotating time of the toner supplying screw 8 on the basis of the video number of an image signal inputted to the image forming apparatus as image information.

There is further provided second toner supply controlling means for forming a standard toner image as a reference toner image on the photosensitive drum 28 by the developing apparatus, and thereafter detecting the density signal of this standard toner image by an optical type sensor 90 (FIG. 1) as a density sensor, and comparing this density signal with a pre-stored initial standard signal and correcting the driving time of the toner supplying screw 8 based on the video count number determined by the first toner supply controlling means, on the basis of the result of the comparison.

Use is made of a method using the first toner supply controlling means and the second toner supply controlling means at the same time.

In such a combined use method, the amount of toner supplied to the developing device is controlled chiefly by the video count method. In the video count method, the level of the output signal of an image signal processing circuit is counted for each pixel, and this count number is integrated by an amount corresponding to the pixels of an original paper size, whereby the video count number per original is obtained (for example, the maximum video count number per sheet of A4 size is 3884×106 for 400dpi and 256 gradations).

This video count number substantially corresponds to the amount of toner consumed in the developing apparatus, and from a conversion table showing the corresponding relation between the video count number and the rotating time of the toner supplying screw 8, the appropriate rotating time of the toner supplying screw 8 is determined by the first toner supply controlling means. For the thus determined rotating time, the toner supplying screw is rotatively driven by a drive motor and the supply of the toner to the developing device is effected.

In the present embodiment, use is made of a method whereby the rotating time of the toner supplying screw 8 is selected from integer times a predetermined unit time (unit block supply).

That is, in the case of the present embodiment, the rotating time of the toner supplying screw 8 per unit block is set to 0.3 sec., and the rotating time of the toner supplying screw 8 per image is restricted to 0.3 sec. or integer times as great as it. The rotating speed of the toner supplying screw during toner supply is controlled so as to be a substantially constant speed except for during the rising and falling of the rotating speed, and accordingly, in the present embodiment, a design is made such that the rotating time of the toner supplying screw is controlled to thereby control the amount of toner supply.

Figure 3:
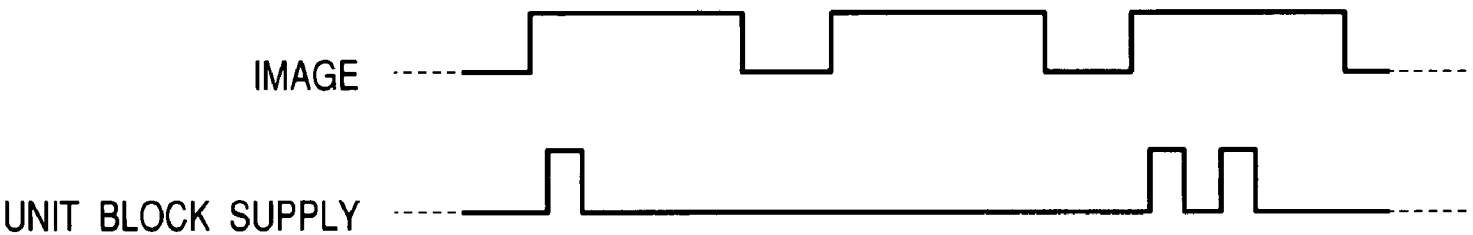
FIG. 3 illustrates the manner of unit block supply according to the present invention.

FIG. 3 shows the manner of specific toner supply.

Figure 4:
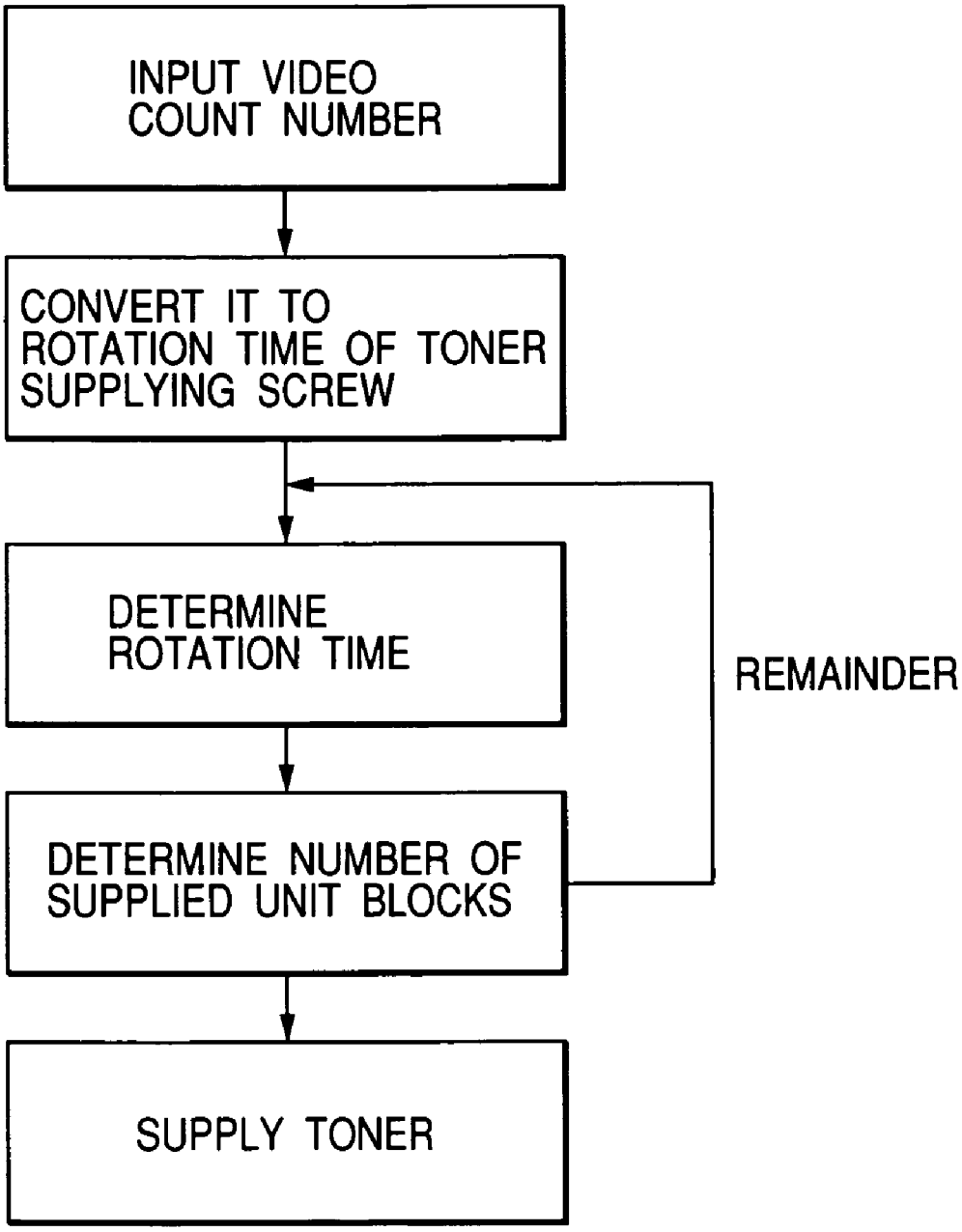
FIG. 4 is a flowchart illustrating the toner supply by the video count method.

When for example, the rotating time of the toner supplying screw 8 obtained from the above-mentioned video count number through the conversion table is 0.42 sec., the number of unit blocks supplied per image in the next image forming operation is one (the rotating time of the toner supplying screw 8 is 0.3 sec.), and the toner supply for the remaining 0.12 sec. is preserved as a remainder, and is added to the rotating time of the toner supplying screw 8 obtained from the next and subsequent video count numbers. The flow of the above-described processing is shown in FIG. 4.

As the advantage of the rotating time of the toner supplying screw 8 being restricted to integer times as great as the predetermined unit time, as described above, it can be mentioned that the amount of toner supply at each time is stabilized.

If toner supply is effected intactly in accordance with the rotating time of the toner supplying screw 8 obtained from the video count number, when the video count number is small, the rotating time will become very short. If the rotating time is short, there is the problem that the influence of the rise time and falling time of a drive motor which drives the toner supplying screw 8 becomes great and the amount of toner supply is not stabilized.

So, as in the present embodiment, always a constant rotating time is provided, whereby the amount of toner supply is stabilized.

In the video count method, if there is a difference between the foreseen amount of toner consumption and the actual amount of toner consumption, the toner density in the developing apparatus will gradually deviate from a proper range and therefore, a patch image which is a standard toner image is formed at a predetermined frequency, and the step of detecting the density of this patch image by an optical sensor (hereinafter referred to as the "patch detecting mode") is executed. The correction of the amount of toner supply obtained from the video count number is effected on the basis of the output value of the optical sensor obtained at this step to thereby make up for the overage and shortage of the amount of toner thereto supplied. In the present embodiment, the patch detecting mode is executed each time image forming for a small-sized original (e.g. A4 lengthwise) is effected 50 times.

When the number of image-formed sheets reaches 50 and the operation timing of the patch detecting mode comes, an electrostatic latent image for the standard toner image having a predetermined area is formed on the photosensitive drum 28, and it is developed by a predetermined developing contrast voltage, whereafter the density signal of this standard toner image is detected by an optical type sensor 90 which is optical density detecting means opposed to the photosensitive drum 28. This density signal Vsig is compared with a reference signal Vref pre-recorded in a memory, and if $$Vsig-Vref<0,$$

it is judged that the density of the patch image is low, that is, the toner density in the developing apparatus is low, and a necessary amount of toner supply and the rotating time of the toner supplying screw corresponding thereto are determined from the difference between Vref and Vsig, and correction is effected in the form of this rotating time being laid on the rotating time determined by the video count method. Conversely, if $$Vsig-Vref\geqq 0,$$

it is judged that the density of the patch image is high, that is, the toner density in the developing apparatus is high, and an unnecessary amount of toner and the stop time of the toner supplying screw 8 corresponding thereto are determined from the difference between Vref and Vsig, and correction is effected in the form of this time being subtracted from the rotating time determined by the video count method.

Figure 5:
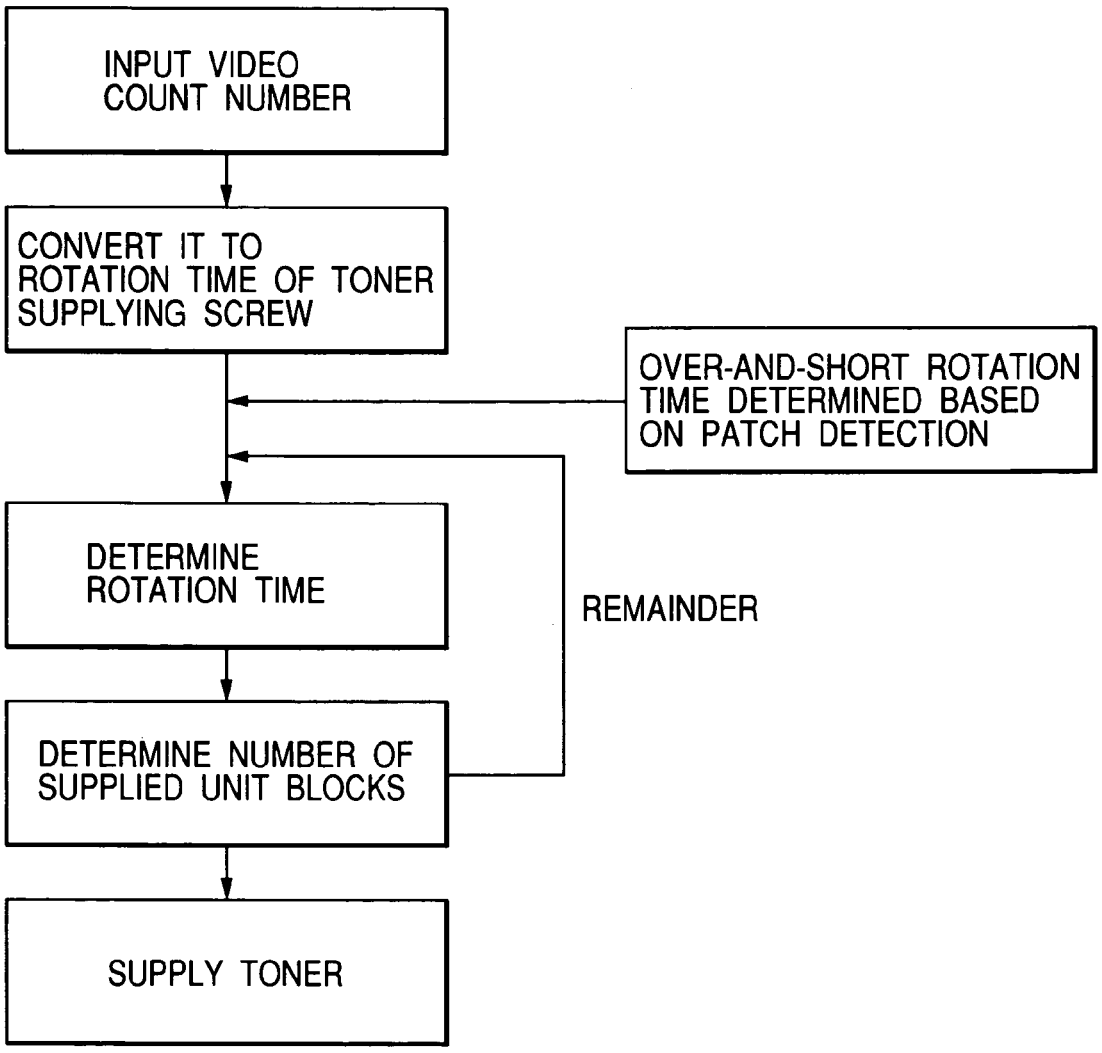
FIG. 5 is a flowchart illustrating the toner supply when the video count method and the patch detecting method are used at the same time.

By such control being effected, an amount of toner supply conforming to the video count number can be corrected and therefore, it becomes possible to correct the deviation of the toner density in the developing apparatus. FIG. 5 shows the flow of the processing when the video count method and the patch detecting method are used at the same time.

Figure 7:
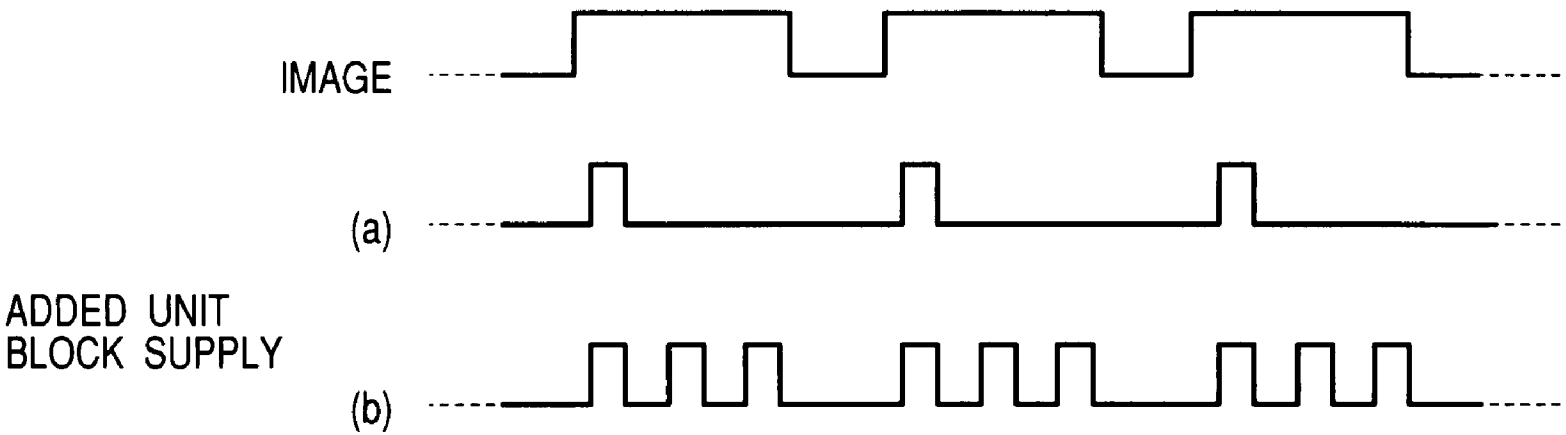
FIG. 7 illustrates that the manner of adding the number of supplied unit blocks differs between a case where the density signal of a reference toner image is equal to or less than a predetermined value and a case where it is great than the predetermined value.

Also, a design is made such that when from the result of the detection in the patch detecting mode, the rotating time of the toner supplying screw 8 is to be increased, that is, when the number of supplied unit blocks is to be added, only one block is added per sheet of image as shown (a) of FIG. 7.

That is, when from the result of the detection in the patch detecting mode, the number of supplied unit blocks is to be added by 10 blocks, it is not added at one time, but a block is added per sheet of image so that additional correction may be completed by ten or more sheets of images. By effecting such control, it is possible to suppress the toner density in the developing apparatus from suddenly rising to thereby cause fog and scattering.

A description will now be made of the detection of the presence or absence of the toner in the present embodiment.

In the present embodiment, without discretely providing in the toner cartridge 5 and the toner supplying portion 9 any sensors for judging whether a toner sufficient for effecting ordinary image forming remains in the toner cartridge 5 and the toner supplying portion 9, i.e., for judging the presence or absence of the toner, the judgment of the presence or absence of the toner is effected by the utilization of the output value of the optical sensor 90 obtained in the above-described patch detecting mode.

Thus, it becomes unnecessary to provide detecting sensors for judging the presence or absence of the toner in the toner cartridge 5 and the toner supplying portion 9 and it becomes possible to curtail the cost.

Figure 6:
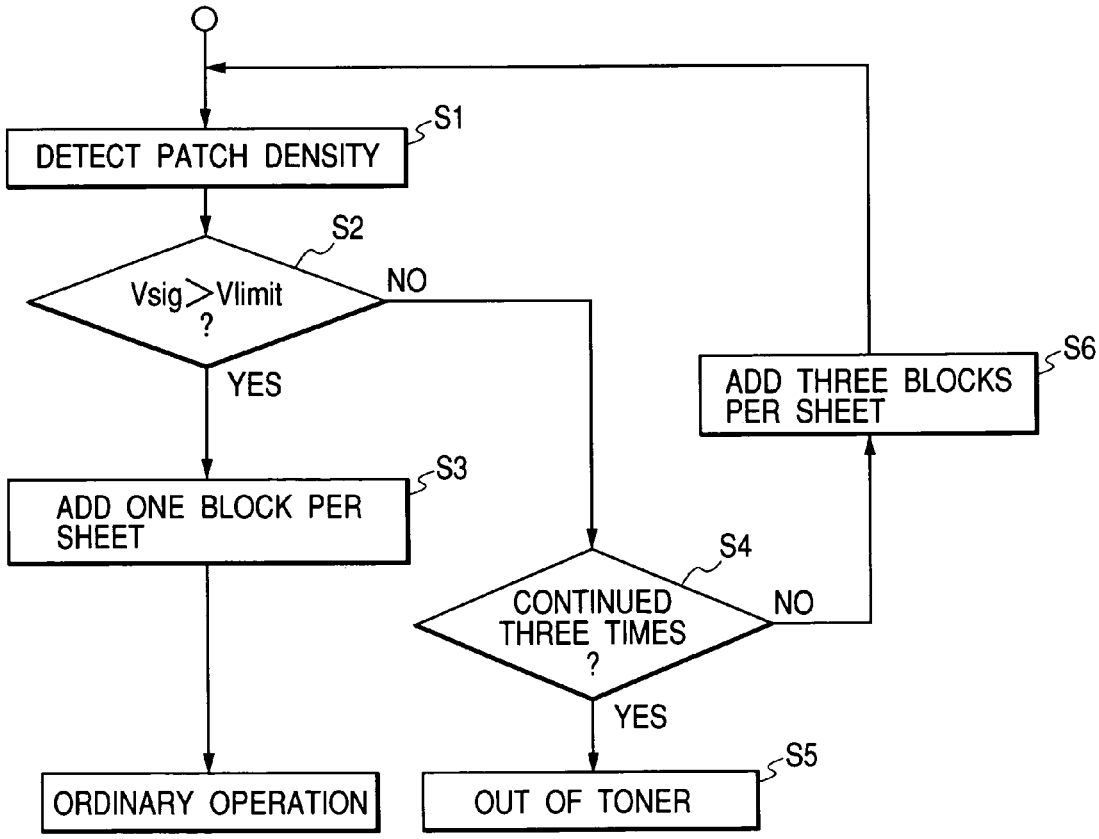
FIG. 6 is a flowchart illustrating the toner presence or absence detecting operation.

FIG. 6 shows the flow of the operation of detecting the presence or absence of the toner.

Referring to FIG. 6, the patch detecting mode is entered, and a patch image is first formed and the patch density is detected by the optical type sensor 90 (S1).

Then, the density signal Vsig detected in the patch detecting mode is compared with a predetermined density signal lower limit value Vlimit (S2), and whether Vsig is over the lower limit value is judged. This density signal lower limit value Vlimit is for judging the presence or absence of the toner and is therefore a value smaller than the above-described reference signal Vref.

When the density signal Vsig is over the lower limit value Vlimit, it is judged that sufficient toner still remains in the toner cartridge 5 to effect ordinary image forming, and as described above, the amount of toner is corrected so that on the basis of the difference between the density signal Vsig and the above-described reference signal Vref, one block is added per sheet of image (S3).

Also, when the density signal Vsig is equal to or less than the lower limit value, it is judged that the amount of remaining toner in the toner cartridge is insufficient to effect the ordinary image forming, but if the presence or absence of the toner is judged from the result of the detection in only one cycle of patch detection mode, there is the possibility of misjudging.

So, the patch detecting mode is repetitively executed at a predetermined frequency and when the density signal Vsig in each patch detecting mode is equal to or less than the lower limit value a predetermined number of times on end, it is better to judge toner absence (for the convenience of description, the term "toner absence" is used in the present embodiment, but "toner absence" is used including a case where actually more or less toner remains).

In the present embodiment, a design is made such that when the density signal Vsig is equal to or less than the lower limit value three times on end, toner absence is judged by the control apparatus (S4 and S5). When toner absence is judged by the control apparatus, the ordinary image forming is prohibited and the operator is called upon to interchange the toner cartridge. The transmission of information to the operator is controlled so that when the image forming apparatus performs the function as a copying machine, the message that "Please interchange the toner cartridge" may be displayed on a liquid crystal display portion as display means provided in the image forming apparatus. Or when the image forming apparatus is network-connected to a personal computer and performs the function as a so-called printer, design may be made such that the signal that "Please interchange the toner cartridge" is transmitted to the personal computer side so as to be displayed on a monitor connected to the personal computer. When the image forming apparatus is a compound machine having the function as a copying machine and the function as a printer, control is effected so that the above-described warning displays may be effected.

While in the present embodiment, the lower limit value is set to a density signal corresponding to 4.5% in terms of toner density conversion, an optimum value is suitably set as this value depending on the construction of the image forming apparatus or the developer in use or the like.

Even if in the above-described patch detecting mode, the density signal is below the lower limit value, when the frequency at which it is below the lower limit value is still once or twice, toner absence is not judged but the continuation of the ordinary image forming operation is permitted and therefore, the above-mentioned number of supplied unit blocks to be added is calculated on the basis of the result of the comparison between the density signal Vsig and the reference signal Vref, and toner supply is effected.

However, there is the possibility that the fact that as described above, in the patch detecting mode, the density signal Vsig becomes equal to or less than the lower limit value Vlimit means that the amount of toner actually supplied to the developing apparatus has not caught up with the amount of toner supply obtained as described above.

That is, there is the possibility that the amount of toner supply relative to the predetermined rotating time of the toner supplying screw 8 has become small and thus, even if one block is added per sheet of image as when the density signal Vsig is over the lower limit value Vlimit, the amount of toner supplied to the developing apparatus is not properly corrected but the amount of toner in the developing apparatus is not much increased.

Thereupon, in a case where the recovery of the toner density in the developing apparatus is delayed and the density of an image formed by the developing apparatus lowers, or the amount of toner supply has become small for some other reason than "toner absence", that is, although a sufficient amount of toner to effect the ordinary image forming is present in the toner cartridge 5, there is the possibility of misjudging "toner absence".

So, in the present embodiment, if the number of supplied unit blocks is to be added when the density signal Vsig is equal to or less than the lower limit value Vlimit, control is effected so that such a supplying operation that supply corresponding to two or more blocks, in the present embodiment, three blocks, is effected may be added unlike a case where the density signal Vsig is over the lower limit value Vlimit, whereby this problem is solved.

When for example, the number of supplied unit blocks is to be added by 15 blocks, three blocks are added per sheet of image as shown in FIG. 7(*b*). The number of supplied unit blocks to be added per sheet of image is thus increased and a reduction in the substantial amount of toner supply is suppressed, whereby it becomes possible to prevent the excessive lowering of the image density or the misjudgment of toner absence.

By effecting such control, it becomes possible to reduce the number of supplied unit blocks. Normally added per sheet of image to thereby prevent fog and scattering, and when toner supply is not effected as desired but the amount of toner supply becomes small in spite of the toner supplying screw being rotatively driven as immediately before the toner in the toner cartridge 5 becomes exhausted, increase the number of supplied unit blocks added per sheet of image, that is, correct the driving time of the toner supplying screw on the long side, thereby preventing the lowering of the image density and the misjudgment of the presence or absence of the toner.

As has been described above, even in the case of an image forming apparatus in which the presence or absence of the toner in the toner storing portion (such as the toner cartridge or the hopper) is judged on the basis of the result of the detection of the patch image, it has become possible to provide an image forming apparatus in which such toner supply control as in the present embodiment is effected to thereby always realize stable toner supply irrespective of the amount of remaining toner in the toner storing portion and which is high in reliability for a long period of use.

Second Embodiment

Again in this embodiment, in an image forming apparatus similar in construction to that described in the first embodiment, the toner supplying method is carried out with the number of supplied unit blocks added per sheet of image as described in the first embodiment, but the present embodiment is characterized in that in addition to it, if the density signal Vsig of the standard toner image detected in the patch detecting mode is below the density signal lower limit value Vlimit, when calculating the correction amount of the rotating time of the toner supplying screw 8 obtained from the difference between the initial reference signal Vref and the density signal Vsig, the correction percentage thereof is heightened.

That is, in the present embodiment, the density signal lower limit value is set to 4.5% in terms of toner density conversion, but when Vsig is greater than the lower limit value Vlimit, the above-mentioned correction percentage is set to 70%. The correction percentage 70% means that actually correction is effected by an amount corresponding to 70% relative to the additional rotating time of the toner supplying screw 8 or the additional number of supplied unit blocks obtained from the difference between Vref and Vsig.

Specifically, when the number of supplied unit blocks to be added obtained from the difference between Vref and Vsig is 10 blocks, actually 7 blocks are additionally supplied and the remaining 3 blocks are not supplied.

If additional correction is effected at a supply percentage 100%, the amount corresponding to a detection error in patch detection is also picked up and corrected, and this leads to the problem that the ripple of the image density inevitably becomes great. So, as in the present embodiment, the correction percentage is lowered, whereby the ripple of the image density can be suppressed to a small level.

In contrast, when Vsig is not more than the lower limit value Vlimit, the correction percentage is selected to 100%. Specifically, when the number of supplied unit blocks to be added is 15 blocks, 15 blocks are intactly added.

In a state in which Vsig is thus considerably low, the substantial amount of toner supply per block is small and therefore, even if the correction percentage is increased, the ripple of the image density as described above does not become great.

By effecting such control, it becomes possible to suppress the ripple of the image density during the normal time when the amount of toner supply per block is great, and when the amount of toner supply per block is small as immediately before the toner becomes exhausted, increase the number of supplied unit blocks added to thereby further prevent the lowering of the image density and the misjudgment of the presence or absence of the toner.

Third Embodiment

The construction of the image forming apparatus and the method of adding the number of supplied unit blocks per sheet of image in this embodiment are similar to those in the first embodiment and the second embodiment, but the present embodiment is characterized in that in addition to them, when the density signal Vsig of the standard toner image detected in the patch detecting mode is equal to or less than the density signal lower limit value Vlimit, weighting is effected on the video count number of the density signal of an image information signal in first toner supply controlling means, and the driving time of the toner supplying portion is controlled on the basis of the weighted video count number.

In the present embodiment, as in the first embodiment and the second embodiment, the density signal lower limit value is set to 4.5% in terms of toner density conversion. When Vsig is greater this lower limit value, the rotating time of the toner supplying screw and the number of supplied unit blocks are determined from the video count number itself per counted original through the conversion table, and a correction amount from the patch detecting mode is added thereto and the number of unit blocks actually supplied is determined.

In contrast, when Vsig is below the lower limit value, weighting is done to the video count number per counted original.

Specifically, the counted video count number is made greater by 1.4 times, and the rotating time of the toner supplying screw and the number of supplied unit blocks are determined from this weighted video count number.

That is, the fact that Vsig is equal to or less than the lower limit value Vlimit means that the substantial amount of toner supply per block has become small and therefore, the deficient amount is corrected by the increment of the video count number so that the substantial amount of toner supply may not be reduced.

Summing up, when the density signal Vsig of the standard toner image is below the lower limit value Vlimit, weighting is effected on the video count number of the density signal of the image information signal, and the driving time of the toner supplying screw is controlled on the basis of the weighted video count number.

By effecting such control, it becomes possible to correct the video count number to an increased side when the amount of toner supply per block as immediately before the toner becomes exhausted, and increase the number of supplied unit blocks to be committed to thereby increase the substantial amount of toner supply, and further prevent the lowering of the image density and the misjudgment of the presence or absence of the toner.

As described above, according to the present embodiment, always stable toner supply can be effected irrespective of the amount of remaining toner in the toner supplying container. The misjudgment of the amount of remaining toner in the toner supplying container can be prevented and the lowering of the image density can be suppressed.

What is claimed is:

1. An image forming apparatus comprising:

a developing device for developing an electrostatic image formed on an image bearing member in accordance with an image signal with a developer including a toner and a carrier;

a toner container for containing the toner;

a supplying member for supplying the toner from said toner container to said developing device; and controlling means for controlling an amount of toner supply to said developing device by moving said supplying member for a driving time corresponding to the image signal; and a density sensor for detecting a density of a reference toner image formed by said developing device, wherein when a value of the density of the reference toner image detected by said density sensor is equal to or less than a predetemined value, said controlling means changes the driving time to lengthen the driving time of said supplying member corresponding to the image signal.

2. An image forming apparatus according to claim 1, wherein the predetermined value is a value for effecting a judgment as to whether to urge the interchange of said toner container.

3. An image forming apparatus according to claim 2, wherein when the density of the reference toner image repetitively formed a predetermined number of times has continuously become equal to or less than the predetermined value, the interchange of said toner container is urged.

4. An image forming apparatus according to claim 1, wherein the predetermined value is a value for effecting judgment as to whether to urge toner supply to said toner container.

5. An image forming apparatus according to claim 4, wherein when the density of the reference toner image repetitively formed a predetermined number of times has continuously become equal to or less than the predetermined value, toner supply to said toner container is urged.

6. An image forming apparatus according to claim 2 or 4, wherein the reference toner image is formed at a predetermined frequency, and the driving time of said supplying member corresponding to the image signal is lengthened each time the frequency at which the output of said density sensor continuously becomes equal to or less than the predetermined value increases.

7. An image forming apparatus according to claim 1, further comprising correcting means for correcting the amount of toner on the basis of an output of said density sensor.

* * * * *

UNITED STATES PATENT AND TRADEMARK OFFICE

CERTIFICATE OF CORRECTION

PATENT NO. : 7,092,647 B2
APPLICATION NO. : 10/793802
DATED : August 15, 2006
INVENTOR(S) : Hideaki Suzuki It is certified that error appears in the above-identified patent and that said Letters Patent is hereby corrected as shown below:

COLUMN 1
Line 29, “in stabilize” should read --in stabilizing--; and
Line 55, “controlly” should read --controlling--.

COLUMN 5
Line 4, “(1k, 1Y,” should read --1K, 1Y,--.

COLUMN 7
Line 37, “as it.” should read --0.3 sec.--.

COLUMN 10
Line 11, “that” should be deleted; and
Line 16, “that” should be deleted.

COLUMN 11
Line 17, “blocks. Normally” should read --blocks normally--.

COLUMN 12
Line 49, “greater” should read --greater than--.

Signed and Sealed this

Twenty-seventh Day of March, 2007

JON W. DUDAS
*Director of the United States Patent and Trademark Office*